US007025608B2

(12) United States Patent
Chen

(10) Patent No.: US 7,025,608 B2
(45) Date of Patent: Apr. 11, 2006

(54) CERAMIC SOCKET

(76) Inventor: Kuo Yi Chen, First Industrial Zone, Chu Yuan Village, Gian Lin, Pin San Town, Long Guan District, Shenzhen City, Guangdong Province (CN)

( * ) Notice: Subject to any disclaimer, the term of this patent is extended or adjusted under 35 U.S.C. 154(b) by 0 days.

(21) Appl. No.: 11/051,033

(22) Filed: Feb. 7, 2005

(65) Prior Publication Data

US 2005/0196988 A1 Sep. 8, 2005

(30) Foreign Application Priority Data

Mar. 3, 2004 (CN) ..... 2004100286541

(51) Int. Cl.
*H01R 25/00* (2006.01)

(52) U.S. Cl. ..... 439/115

(58) Field of Classification Search ..... 439/110–119, 439/122, 207–216, 261, 259, 263, 533
See application file for complete search history.

(56) References Cited

U.S. PATENT DOCUMENTS 4,676,567 A * 6/1987 Mouchi ..... 439/207
4,861,273 A * 8/1989 Wenman et al. ..... 439/111
5,755,508 A * 5/1998 Wheaton ..... 362/249
6,229,107 B1 * 5/2001 Flint et al. ..... 200/51.09
6,854,988 B1 * 2/2005 Marmaropoulos et al. .. 439/110
2003/0210982 A1 * 11/2003 Chen ..... 416/5

* cited by examiner

*Primary Examiner*—J. F. Duverne
(74) *Attorney, Agent, or Firm*—Rosenberg, Klein & Lee

(57) ABSTRACT

The invention is relative to a ceramic socket, which is established on the baseboard of lamps and lanterns through bearing leg. The said socket consists of a body and a cap. The lateral side of body where the cap fastens on it and towards the baseboard has wire entrances for polar wires. Polar wires go into the baseboard through their independent entrance connect to corresponding slug and tongue in order to settle wires between the socket and the baseboard. This structure avoids the shadow projected on the lamp body to affect the appearance. On the other hand, wires being concealed between the socket and the baseboard are isolated from lamps. Even it multiple lamps sit on a single socket, this structure will still remove hidden peril of short circuit even when the electrical insulating material of the wire sheet is heated or damaged.

9 Claims, 3 Drawing Sheets

CERAMIC SOCKET

FIELD OF THE INVENTION

The invention relative to a socket used to support lamp bulb in illuminator field, specially relative to a ceramic spiral socket supports the lamp bulb through screw thread.

BACKGROUND OF THE INVENTION

The ceramic socket has widely usage based on its features of anti-moist, resistant to corrosion, thermo stability and earth leakage protection.

This invention is mainly focus on ceramic socket through screw thread to support lamp bulb, that is, install the screw bulb on ceramic socket.

The previous ceramic screw socket shown in FIG. 1, where in an illuminator is fixed on the proper place through baseboard 3'; the socket 1' installed on the baseboard 3' through bearing leg 2'; the socket 1' is composed by a body 11' and a cap 12'; the internal lateral of the open-end 111' of the body 11' has screw indents to hold illuminators; the cap 12' fastens on the other end 112' of the body 11'; the lateral of the end 112' of the body 11' (away from the illumination baseboard 3' and face to the lamp body 5') has an entrance 113' for polar wires 4' ( power line and null line) to enter the socket 1'; wire 4' penetrated the entrance 113', entered the socket 1' and contacts the electric connectors.

The disadvantages of the previous ceramic sockets contain two following points at least:

Firstly, wire 4' is away from the baseboard 3' and closer to the shell 5' of the illuminator, when light up the illuminator, the shadow of the said wire 4' projected on the shell 5'. The case even worse when multiple sockets 1' set on a single baseboard 3', shadows of wires 4' are disordered and jumbled together to withdraw the appearance. Nowadays, beside the lighting purpose, the appearance of illuminators is importance, sometimes is the most important consideration to users.

Secondly, the wire 4' comes out of the entrance 113' and is away from the baseboard 3' will closer to even toughed the lamp bulb, the case even worse when multiple sockets 1' are set on a single baseboard 3'. Short circuit and electricity leakage is easily trigged under this environment.

As a result, the previous method requires a new technology to overcome the above defects and inconvenient on the ceramic sockets.

SUMMARY OF THE INVENTION

This invention is relative to a structure of the said ceramic socket guarantees wires to be fasten between the baseboard and the socket to overcome the mentioned defects and inconvenient.

To fulfill the above purpose, the method according to the invention description is as follows:

A ceramic socket sets on the baseboard of illuminator through bearing leg. The said socket consists of a body and a cap. One end of the body is opened and its internal lateral has metal whorl slice, the other end fasten the cap and the internal bottom of the end has slug and tongue isolated from each other; the said slug is electrically connected metal whorl slice; the said tongue and the said slug are independently connected to their belonging polar wires electrically; the end of the said body where the cap fastens on is self-enclosed except the preserved entrance for polar wires and preserved space for socket installation. The lateral side of the body where the cap fastens on and faces the baseboard has opened wire entrances for polar wires. Polar wires penetrated into the body from its own entrance, and electrically connected their relative slug and tongue correspondingly.

This invention has unique structure to fix wires between the baseboard and the socket, in another word, wires is blocked away by the socket when observation from the lamp body. Therefore, shadow is avoided under lighting to provide a better appearance. On the other hand, wires bounded between the baseboard and the socket, isolated from the bulb, and it also isolated from other wires and bulbs when multiple sockets implemented in a single baseboard to remove hidden peril of short circuit even when the electrical insulating material of the wire sheet is heated or damaged.

DESCRIPTION OF THE PREFERRED EMBODIMENTS

The foregoing aspects and many of the attendant advantages of this invention will be more readily appreciated as the same becomes better understood by reference to the following detailed description, when taken in conjunction with the accompanying drawings.

Figure 1:
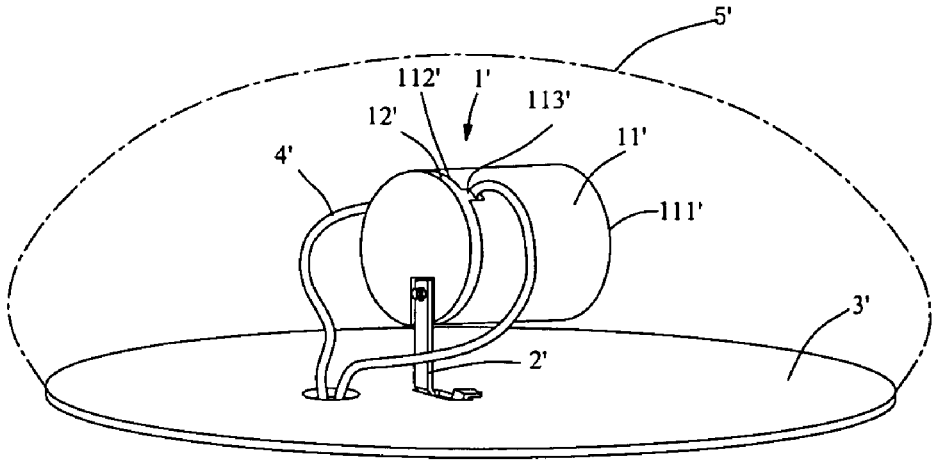
FIG. 1 is shown the stereoscopic diagram of the previous ceramic socket setting on the baseboard.
Figure 2:
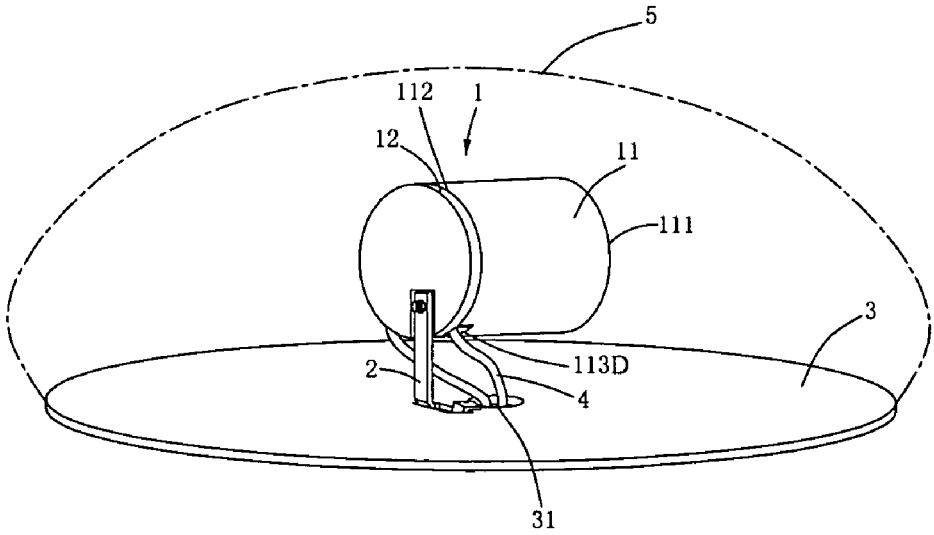
FIG. 2 is shown the stereoscopic diagram of the ceramic socket of this invention setting on the baseboard.
Figure 3:
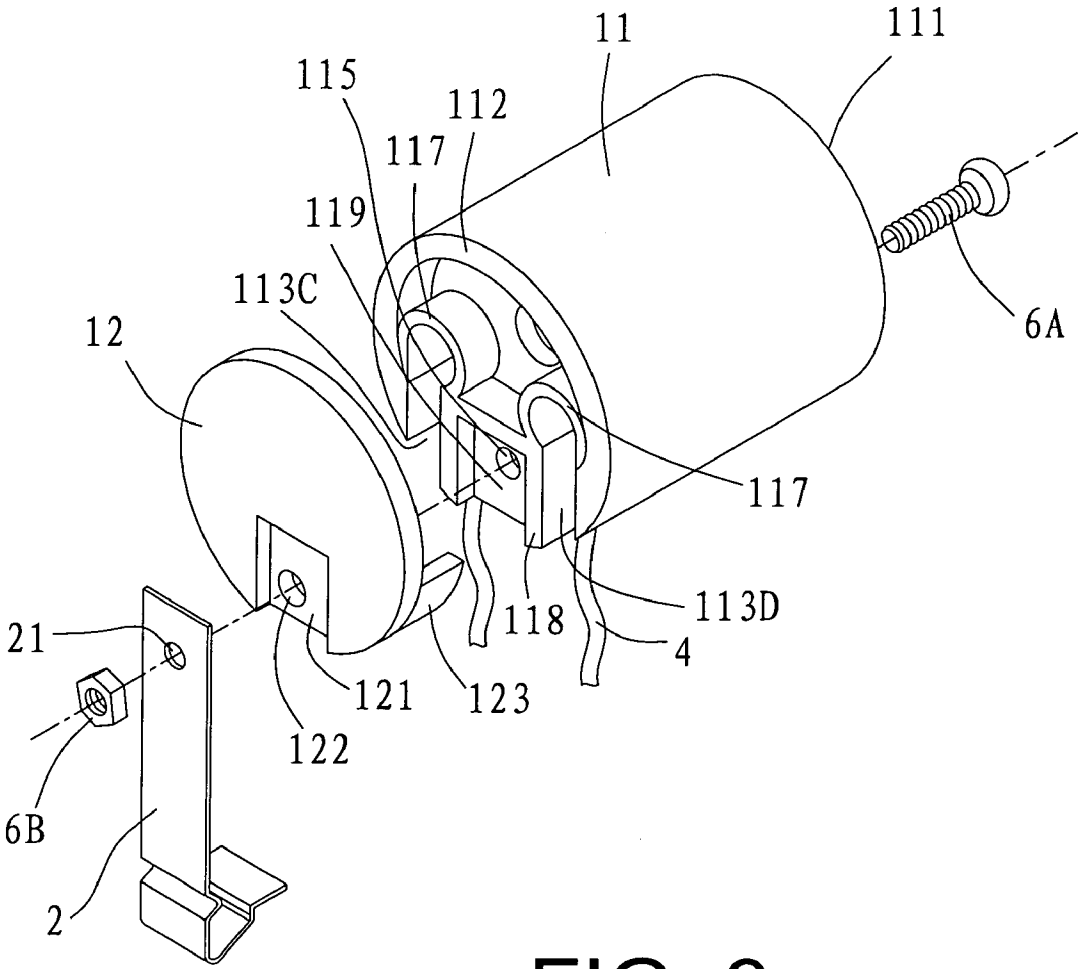
FIG. 3 is shown the decomposed stereoscopic diagram of this invention.
Figure 4:
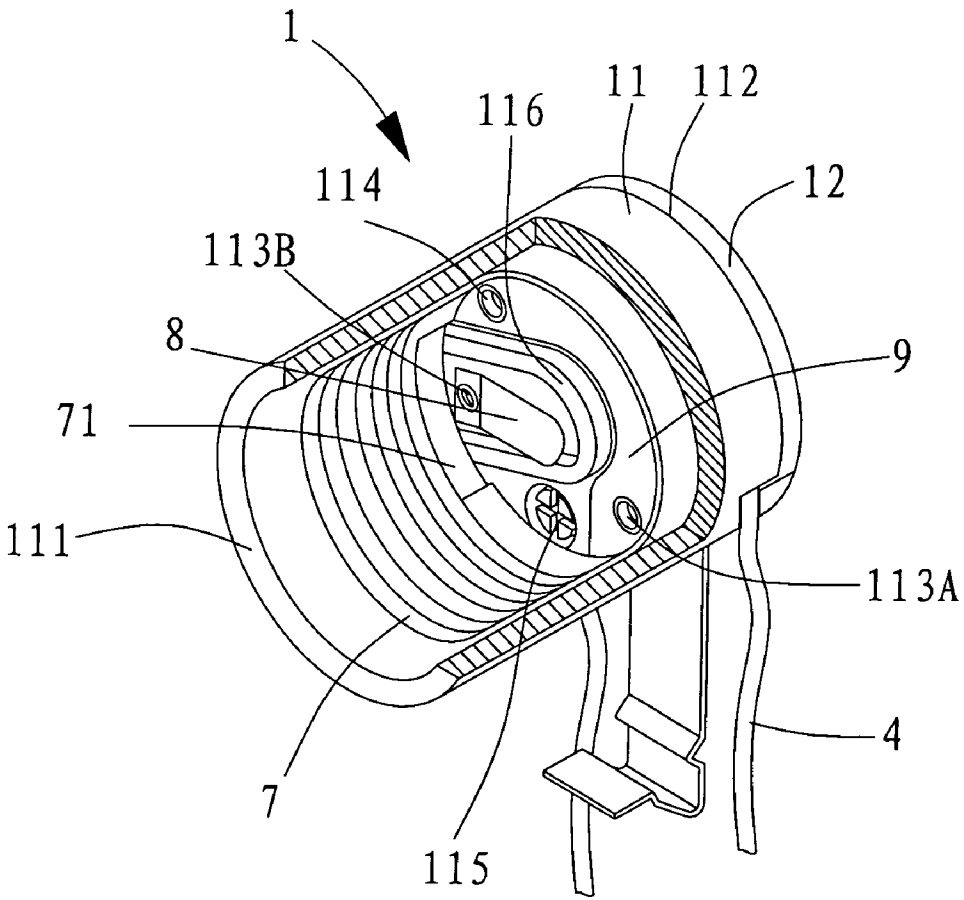
FIG. 4 is shown the partial section view of this invention.

As shown in FIG. 2 to 4, wherein the socket 11 sets on the baseboard 3 through bearing leg 2, the said socket 1 consists of a body 11 and a cap 12.

The end 111 of the body 11 is open, its internal lateral has metal whorl slice 7; the other end 112 of the body 11 self-enclosed and has two sets of diagonal holes formed a cross pattern, wherein wire holes 113A and 113B as a set, installation holes 114 and 115 as another set. The internal bottom of the end 112 of the body 11 installed tongue 8 and slug 9, the establish methods between tongue 8 and slug 9 can be any common ways. The diagram is shown the said tongue 8 riveting into the wire hole 113B, the slug 9 riveting into wire hole 113A and installation hole 114. The said tongue 8 and the slug 9 are isolated from each other by a raised "U" shape ceramic seat 116 from the internal bottom of the end 112. The slug 9 is electrically, can also be physically connected the metal whorl slice 7 to form a component. Metal whorl slice 7 facing the raised "U" shape ceramic seat 116 and the tongue 8 has a gap 71 to guarantee the metal whorl slice 7 and the slug 9 are electrically and physically isolated from the tongue 8. The lateral of the end 112 directly faced the baseboard 3 has entrances 113C and 113D corresponding relative to wire holes 113A and 113B. The polar wire 4 (power line and null line) goes into the said body 11 through their own wire entrances 113C and 113D and then joint slug 9 and tongue 8 respectively. The external bottom of the end 112 faced the wire entrances 113C and 113D has arc socket 117 to conceal wire holes 113A and 113B to avoid wires disorder after penetrated to the end 112. An N shape body 118 extend from the vaulted body 117 of the external bottom of end 112. The N shape body 118 circulated a flute 119, and the said installation hole 115 is settled inside the said flute 119.

The cap 12 facing the flute 119 has a matching flute 121, the flute 121 has an installation hole 122 directly faced the installation hole 115 of the body 11. The bearing leg 2 has an installation hole 21 directly faced the installation hole 122 of the cap 12. A bolt 6A penetrated the said installation holes 115, 122 and 21 in proper sequence then lock by a screw nut 6B to form the said body 11, the said cap 12 and the said bearing leg 2 together as one unique component which then being supported by the bearing leg 2 on the baseboard 3.

The edge of the cap 12 faced the wire entrances 113C and 113D of the body 11 has protruded pillar 123, when the cap 12 fastens on the end 112 of the body 11, the protruded pillar 123 grasps the said wire 4 and seals in the wire entrances 113C and 113D in order to stale the wire 4.

The wire hole 31 sits on the baseboard 3 directly faced wire entrances 113C and 113D of the socket 1 that has the shortest distance to penetrate through the said baseboard 3 after the wire 4 comes out from the socket 1 in order to prevent wire disorder.

As a result, this invention of ceramic socket has better structure to locate the wire 4 between the socket 1 and the baseboard 3, in another word, wires 4 is blocked away by the socket 1 when observation from the lamp body 5. Therefore, shadow is avoided under lighting to provide a better appearance. On the other hand, wires 4 bounded between the baseboard 3 and the socket 1, isolated from the bulb, and it also isolated from other wires and bulbs when multiple sockets 1 implemented in a single baseboard 3 to remove hidden peril of short circuit even when the electrical insulating material of the wire sheet is heated or damaged.

Above are descried the optimal implementation of present invention, it will be apparent that various changes and modifications can be made without departing from the scope of the invention as defined in the claims.

What is claimed is:

1. A ceramic socket setting on a baseboard of an illuminator through a bearing leg, said socket comprising a body and a cap, one end of the body being open and a metal whorl slice being fixed on an internal lateral wall thereof, the other end of the body having a cap fastened to an outer side thereof and an internal side of said other end having a slug and a tongue disposed thereat and isolated from each other, said slug being electrically connected to the metal whorl slice, said tongue and said slug being respectively electrically connected to a pair of polar wires, the end of said body to which the cap is fastened being self-enclosed except for an opening at each of a pair of polar wire entrances for said pair of polar wires and a space for socket installation, said openings of said polar wire entrances being located on a lateral said of said body adjacent said end thereof to which said cap is fastened, each of the polar wires penetrating into the socket from a respective one of said openings of said pair of polar wire entrances and being separately electrically connected to the slug and the tongue.

2. The ceramic socket as claimed in claim 1, wherein the end of the body where the cap fastens thereto having two sets of diagonal holes forming a cross pattern defined by a hole in one of said polar wire entrances, an installation hole of the slug, a hole in said other of said pair of polar wire entrances and a socket installation hole, wherein said tongue is riveted in said hole in one of said polar wire entrances and the slug is riveted in said hole of the other polar wire entrance and the installation hole of the slug.

3. The ceramic socket as claimed in claim 1, wherein said tongue and said slug are isolated from each other by a U-shaped ceramic seat, the seat extending from the internal side of the end where the cap fastens thereto.

4. The ceramic socket as claimed in claim 1 or claim 3, wherein the slug is electrically and physically connected to the metal whorl slice to form a component.

5. The ceramic socket as claimed in claim 3, wherein the metal whorl slice has a gap facing the U-shaped ceramic seat and the tongue.

6. The ceramic socket as claimed in claim 1 or claim 2, wherein the end of the body to which the cap fastens having a pair of concealed arc sockets, said pair of arc sockets respectively substantially covering each polar wire entrance.

7. The ceramic socket as claimed in claim 6, wherein said arc sockets extends in an N shape, the N shape being enclosed and forming a sink for installing the ceramic socket, said cap having an indent directly facing said sink of said body, said indent directly facing said socket installation hole having a cap installation hole, said bearing leg having a bearing hole aligned with the installation hole of the cap, a bolt pin passing though the socket installation hole, the cap installation hole and the bearing hole in sequence, and secured by a screw nut to form the body, the cap and the bearing leg thereby being joined together.

8. The ceramic socket as claimed in claim 1, wherein an edge of said cap directly faces the wire entrances of the body and has matching protruded pillars, each of said protruded pillars nipping a respective one of said polar wires and being concealed in a corresponding polar wire entrance.

9. The ceramic socket as claimed in claim 1, wherein said baseboard is disposed directly opposite to the ceramic socket and has an open wire entrance formed therethrough.

* * * * *